US007697869B2

(12) United States Patent
Okimura et al.

(10) Patent No.: US 7,697,869 B2
(45) Date of Patent: Apr. 13, 2010

(54) IMAGE FORMING APPARATUS WITH IMAGE FORMING UNIT NEARLY ORTHOGONAL TO DEVELOPER SUPPLY UNIT

(75) Inventors: Naomasa Okimura, Saitama (JP); Takeshi Okoshi, Saitama (JP); Yukinori Sezaki, Saitama (JP)

(73) Assignee: Fuji Xerox Co., Ltd., Minato-ku, Tokyo (JP)

( * ) Notice: Subject to any disclaimer, the term of this patent is extended or adjusted under 35 U.S.C. 154(b) by 238 days.

(21) Appl. No.: 11/392,649

(22) Filed: Mar. 30, 2006

(65) Prior Publication Data

US 2007/0065182 A1 Mar. 22, 2007

(30) Foreign Application Priority Data

Sep. 22, 2005 (JP) ..... P2005-274964

(51) Int. Cl.
*G03G 15/08* (2006.01)

(52) U.S. Cl. ..... 399/258; 399/111; 399/113; 399/119; 399/120

(58) Field of Classification Search ..... 399/111, 399/113, 119, 120, 258
See application file for complete search history.

(56) References Cited

U.S. PATENT DOCUMENTS 4,937,625 A * 6/1990 Kato et al. ..... 399/258
2001/0043826 A1* 11/2001 Mizoguchi et al. ..... 399/359
2002/0025197 A1* 2/2002 Mizoguchi et al. ..... 399/262
2002/0048467 A1* 4/2002 Funayama et al. ..... 399/119
2002/0085857 A1* 7/2002 Kim et al. ..... 399/119
2003/0072590 A1* 4/2003 Shimaoka et al. ..... 399/258
2003/0185589 A1* 10/2003 Fujita ..... 399/111
2004/0141774 A1* 7/2004 Hayashi et al. ..... 399/258
2004/0175203 A1* 9/2004 Kamimura ..... 399/111
2005/0002688 A1* 1/2005 Jeong et al. ..... 399/110

FOREIGN PATENT DOCUMENTS

CN 1525258 A 9/2004
JP 9-68843 A 3/1997
JP 2003-295562 A 10/2003

* cited by examiner

*Primary Examiner*—David M Gray
*Assistant Examiner*—Ryan D Walsh
(74) *Attorney, Agent, or Firm*—Sughrue Mion, PLLC

(57) ABSTRACT

An image forming apparatus includes an image forming unit having a developer accepting part accepting supplied developer and a developer supply unit having a developer supply part supplying the developer to the developer accepting part, wherein the developer accepting part is provided near one end in the longitudinal direction of the image forming unit, the developer supply unit is provided near one end in the longitudinal direction of the developer supply unit, and the image forming unit and the developer supply unit are arranged in a position where one end in the longitudinal direction of the developer supply unit is nearly orthogonal to the image forming unit near one end in the longitudinal direction of the image forming unit.

11 Claims, 11 Drawing Sheets

IMAGE FORMING APPARATUS WITH IMAGE FORMING UNIT NEARLY ORTHOGONAL TO DEVELOPER SUPPLY UNIT

BACKGROUND OF THE INVENTION

1. Field of the Invention

The present invention relates to an image forming apparatus.

2. Description of the Related Art

Such a technology has been known that: an image forming apparatus such as a copying machine, a facsimile device, a printer, or the like includes an image forming unit having a developer accepting part having a developer inlet, and a developer supply unit having a developer supply part having a developer supply port from which developer is supplied to the developer accepting part; and the image forming unit and the developer supply unit are arranged so that the longitudinal direction of the image forming unit is orthogonal to the longitudinal direction of the developer supply unit, for example, as shown in JP-A-2003-295562.

However, in the related art, the developer accepting part is provided for the image forming unit so as to protrude outward in the longitudinal direction. Therefore, in order to arrange the developer supply part in the opposed position to this developer accepting part, and make possible the supply of the developer from the developer supply part to the developer accepting part, it is necessary to arrange the developer supply unit on the outside in the longitudinal direction of the image forming unit. Hereby, there is a problem that the size of the image forming apparatus becomes large in the longitudinal direction of the image forming unit.

SUMMARY OF THE INVENTION

The invention has been made in view of the above circumstances and provides an image forming apparatus.

According to an aspect of the invention, an image forming apparatus includes an image forming unit having a developer accepting part which accepts supplied developer, and a developer supply unit having a developer supply part which supplies the developer to the developer accepting part. Herein, the developer accepting part is provided near one end in the longitudinal direction of the image forming unit, and the developer supply unit is provided near one end in the longitudinal direction of the developer supply unit, and the image forming unit and the developer supply unit are arranged so that one end in the longitudinal direction of the developer supply unit is nearly orthogonal to the image forming unit near one end in the longitudinal direction of the image forming unit. Therefore, even in case that the developer supply unit is arranged on the inside in the longitudinal direction of the image forming unit, the developer supply part can be arranged in the position opposed to the developer accepting part. Hereby, it is prevented that the size of the image forming apparatus in the longitudinal direction of the image forming unit becomes large, and the image forming apparatus can be miniaturized.

Further, preferably, the developer supply unit is arranged in a position where at least its part overlaps with the image forming unit in a horizontal direction. Therefore, it is prevented that the vertical size of the image forming apparatus becomes large, and the image forming apparatus can be miniaturized.

Further, preferably, the image forming apparatus includes an image bearing member and a latent image forming device which forms a latent image on this image bearing member, wherein the developer supply unit and the latent image forming device are arranged side by side in the longitudinal direction of the image bearing member.

Further, preferably, the developer supply unit is attached to an image forming apparatus body detachably, and the direction in which the developer supply unit is pulled out from the image forming apparatus body is nearly opposite to the direction in which the image forming unit is set.

Further, preferably, the developer supply unit is attached to the image forming apparatus body detachably, and the direction in which the developer supply unit is pulled out from the image forming apparatus body is nearly vertical to the direction in which the image forming unit is set.

Further, preferably, the image forming unit and the developer supply unit are attached to the image forming apparatus body detachably, and the direction in which the image forming unit is pulled out from the image forming apparatus body is nearly opposite to the direction in which the developer supply unit is pulled out from the image forming apparatus body. Therefore, the image forming unit the developer supply unit can be individually pulled out from the image forming apparatus body respectively.

Further, preferably, the image forming unit and the developer supply unit are attached to the image forming apparatus body detachably, and the direction in which the image forming unit is pulled out from the image forming apparatus body is nearly vertical to the direction in which the developer supply unit is pulled out from the image forming apparatus body. Accordingly, the image forming unit and the developer supply unit can respectively be pulled out independently from the image forming apparatus body.

Further, preferably a coupling part is provided for the developer supply unit, a coupled part is provided for the image forming unit, and the coupling part and the coupled part are coupled to each other.

Further, preferably, the image forming apparatus includes an image forming apparatus body having an opening part which is used for attachment and detachment of at least one of the image forming unit and the developer supply unit; an opening and closing cover which opens or closes the opening part; and a coupling release unit which releases the coupling state between the image forming unit and the developer supply unit in cooperation with the opening operation of this opening and closing cover. Therefore, in cooperation with the opening operation of this opening and closing cover, coupling between the image forming unit and the developer supply unit is released.

Further, preferably the image forming unit includes a developer removing device which removes developer from a surface of the image bearing member, and a developer discharge part which discharges the developer removed by the developer removing device; and the developer supply unit includes a developer pick-up part which picks up the developer discharged from the developer discharge part, and a developer accumulation part in which the developer picked up by this developer pick-up part is accumulated. Therefore, the exchange of the developer supply unit makes both of developer supplement and developer pick-up possible.

Further, preferably the developer discharge part is provided in the nearly orthogonal direction to the longitudinal direction of the image forming unit, and the developer pick-up part is provided at one end in the longitudinal direction of the developer supply unit. Therefore, even in case that the developer supply unit is arranged on the inside in the longitudinal direction of the image forming unit, the developer discharge part can be arranged in the position opposed to the developer pick-up part. Hereby, it is prevented that the size of the image forming apparatus in the longitudinal direction of the image forming unit becomes large.

[Advantage of the Invention]

According to the invention, the image forming apparatus can be miniaturized.

BRIEF DESCRIPTION OF THE DRAWINGS

Preferred embodiment of the present invention will be described in detail based on the following figures, wherein.

DETAILED DESCRIPTION OF THE INVENTION

Figure 1:
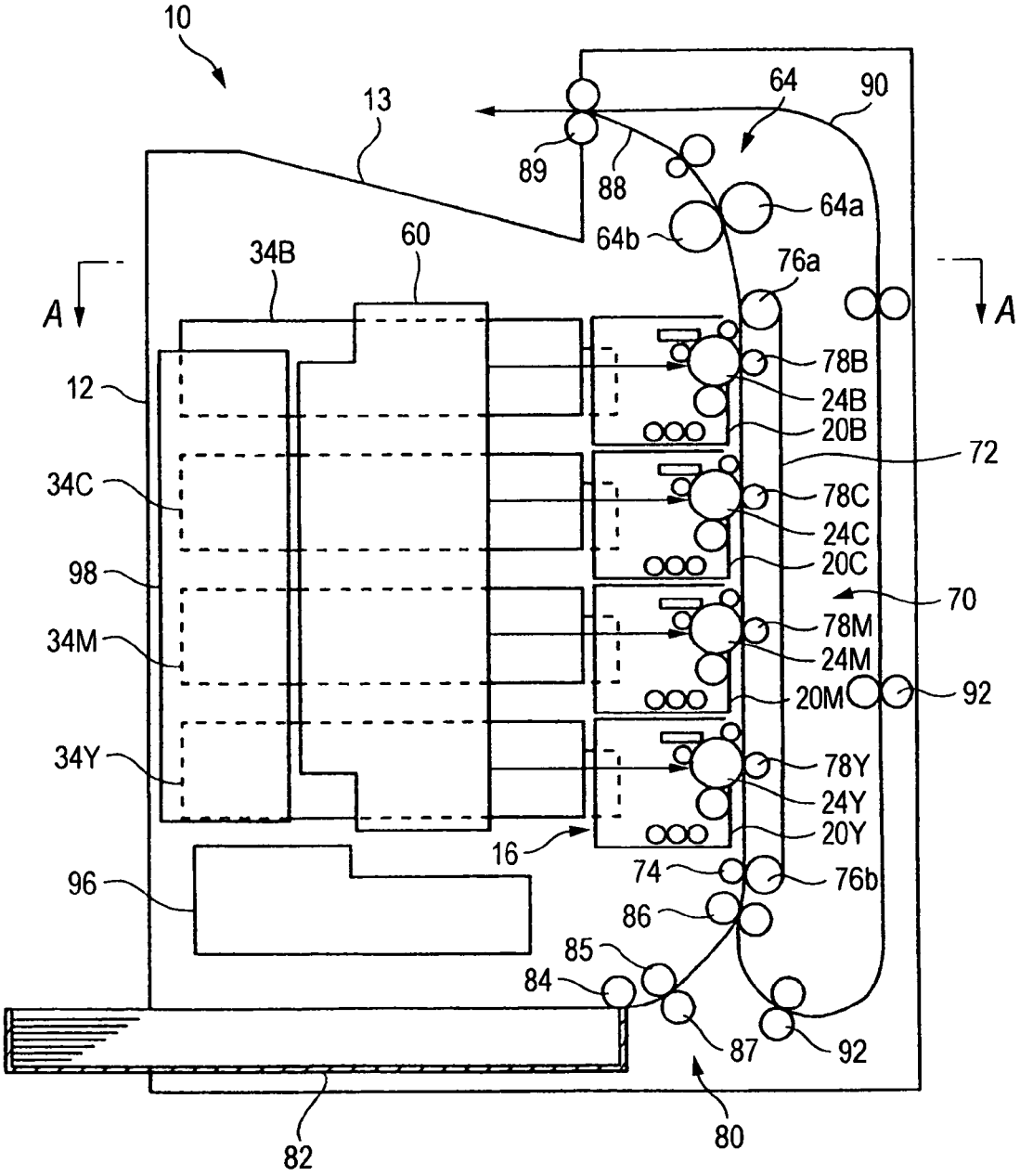
FIG. 1 is a sectional view showing the constitution of an image forming apparatus according to a first embodiment of the invention.

Next, embodiments of the invention will be described with reference to drawings.

FIGS. 1 to 6 show respectively an image forming apparatus 10 according to an embodiment of the invention. This image forming apparatus 10 includes an image forming apparatus body 12, and in this image forming apparatus body 12, an image forming part 16, a sheet supply and transport system 80, a power source unit 96, and a controller 98 are arranged.

Figure 3:
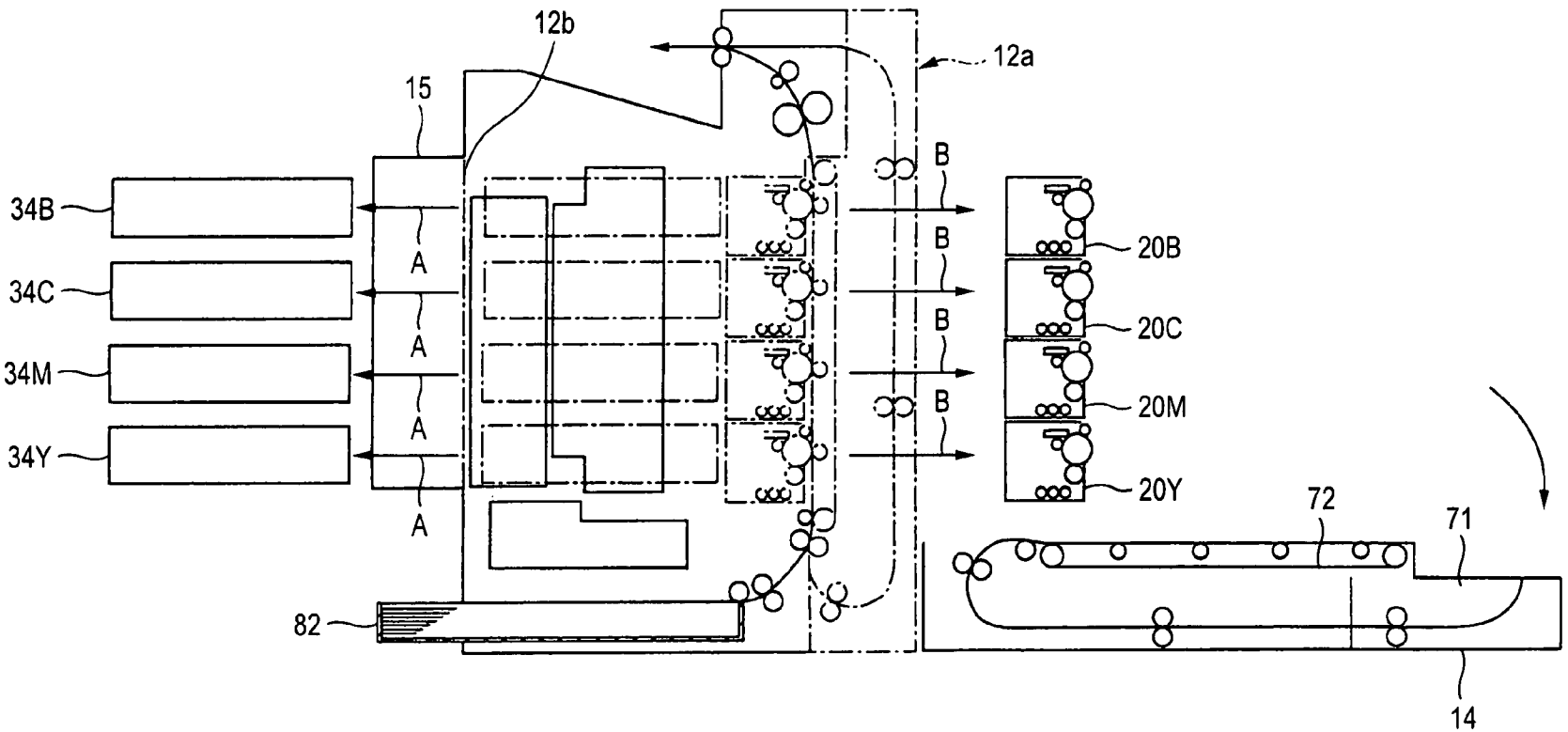
FIG. 3 is an explanatory view showing a state where an image forming unit and a developer supply unit are taken out from the image forming apparatus according to the first embodiment of the invention.

In the image forming apparatus body 12, there are provided a discharge part 13 onto which a sheet on which an image has been formed is discharged, an opening part 12*a* on the right side of the body 12 in FIGS. 1 and 3, and an opening part 12*b* on the left side of the same. The opening part 12*a* is used for attachment and detachment of at least one of an image forming unit 20Y, 20M, 20C, 20B and a developer tank 34Y, 34M, 34C, 34B. Through this opening part 12*a*, the image forming units 20Y, 20M, 20C, 20B are attached or detached to/from the image forming apparatus body 12. To this opening part 12*a*, a front cover 14 used as an open cover is attached. When this front cover 14 is closed, the opening part 12*a* is shut as shown in FIG. 1; and when the front cover 14 is opened, the opening part 12*a* is put in an open state as shown in FIG. 3.

The opening part 12*b* is used for attachment and detachment of the developer tanks 34Y, 34M, 34C, 34B described later to/from the image forming apparatus body 12. For this opening part 12*b*, an opening and closing door 15 is provided. In a state where the opening and closing door 15 is opened as shown in FIG. 3 and the opening part 12*b* is open, the attachment and detachment of the developing tanks 34Y, 34M, 34C, 34B to/from the image forming apparatus body 12 are performed.

An image forming part 16 is an electrophotographic type of forming a color image, and includes image forming units 20Y, 20M, 20C and 20B, developer tanks 34Y, 34M, 34C and 34B, a laser writing device 60, a transfer device 70, and a fixing device 64. The image forming units 20Y, 20M, 20C and 20B are detachably attached to the image forming apparatus body 12 and include their development devices 28Y, 28M, 28C and 28B. The developer tanks 34Y, 34M, 34C and 34B are used as developer supply units in which developers to be supplied to the development devices 28Y, 28M, 28C and 28B are housed respectively. The laser writing device 60 is used as a latent image forming device which forms latent images by light on photoconductors 24Y 24M, 24C and 24B used as image bearing members which the respective image forming units 20Y, 20M, 20C and 20B have. The transfer device 70 transfers developer images formed on the respective photoconductors 24Y 24M, 24C and 24B onto a sheet used as transferred body, and the fixing device 64 fixes the developer images transferred by the transfer device 70 onto the sheet.

The image forming unit 20Y is used for forming a yellow developer image, the image forming unit 20M is used for forming a magenta developer image, the image forming unit 20C is used for forming a cyan developer image, and the image forming unit 20B is used for forming a black developer image. The image forming units are arranged in the image forming apparatus body 12, along a transport belt 72 described later, in the vertical direction in ascending order of the image forming units 20Y, 20M, 20C and 20B. Though the respective image forming units 20Y, 20M, 20C and 20B are different in color of the using developer, they are the same in structure. Therefore, they will be described below generically as an image forming unit 20.

Figure 4:
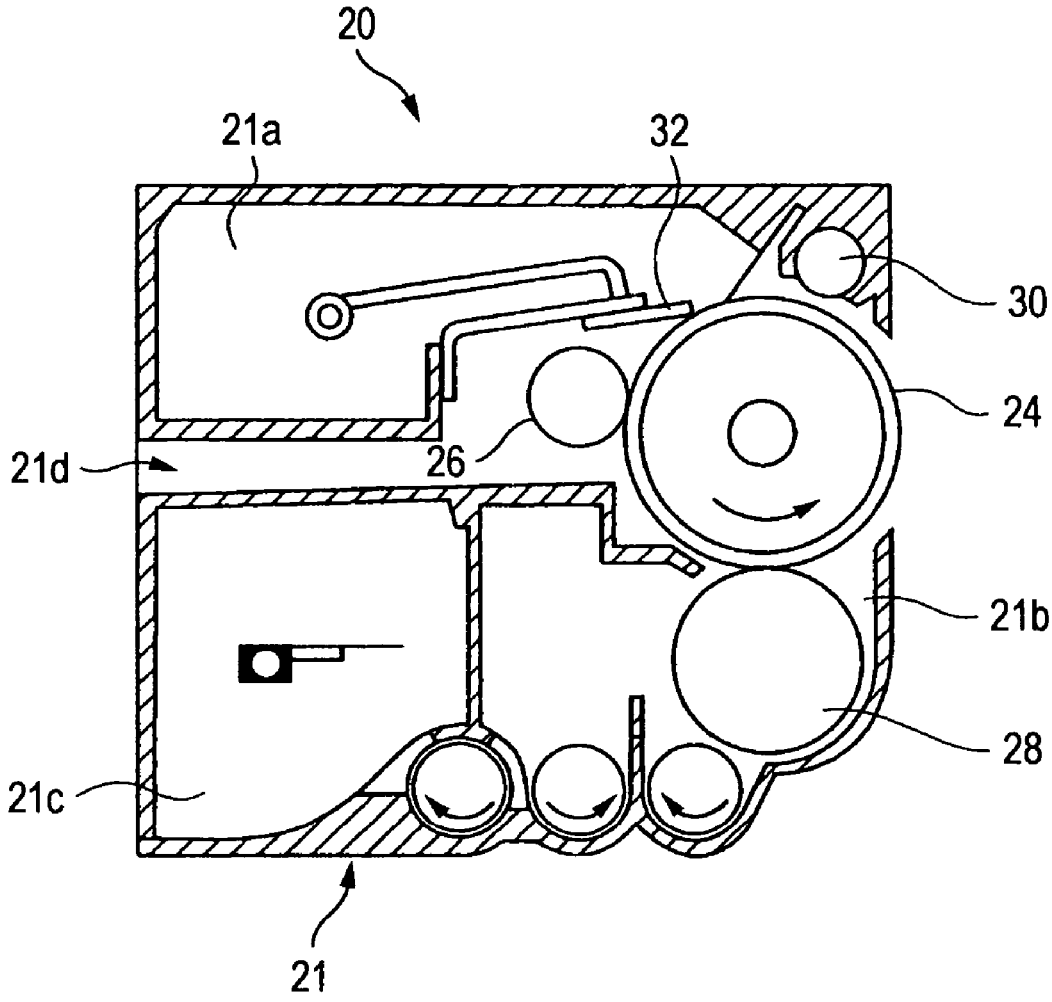
FIG. 4 is a sectional view showing the image forming unit of the image forming apparatus according to the first embodiment of the invention.
Figure 5:
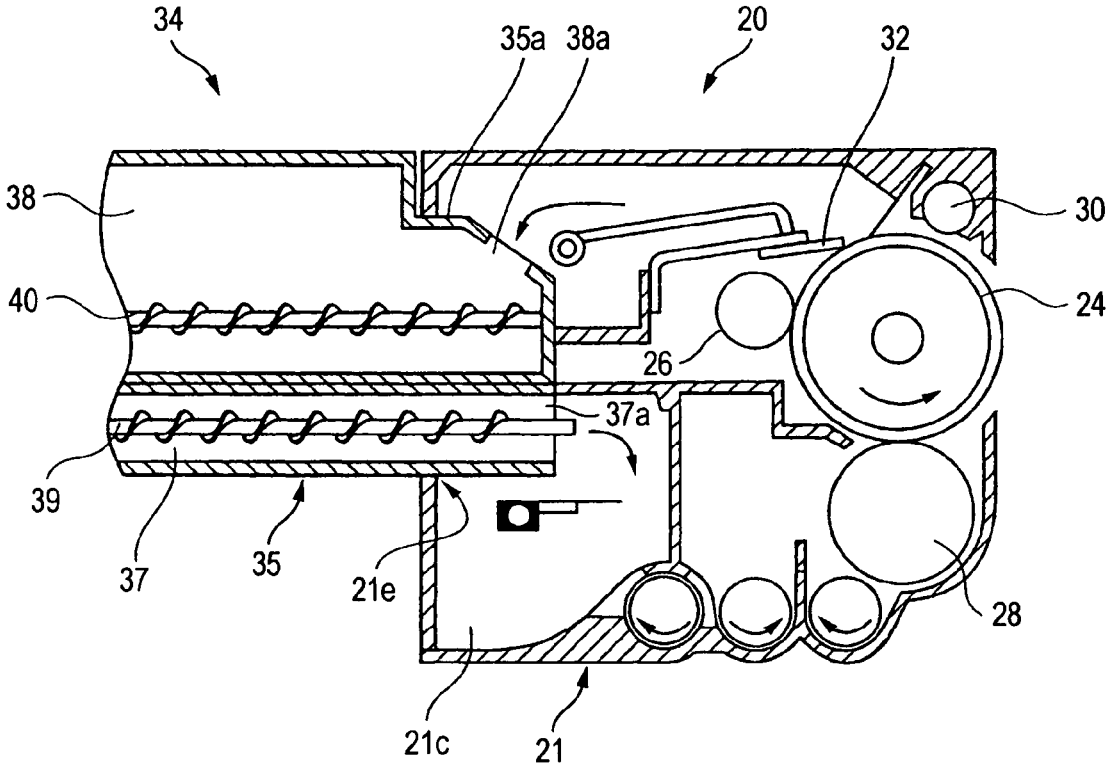
FIG. 5 is a sectional view showing a state where the image forming unit and the developer supply unit which the image forming apparatus according to the first embodiment of the invention has are coupled to each other.

The image forming unit 20, as shown in FIGS. 4 and 5, has an image forming unit housing 21. The inside of this image forming unit housing 21 is divided into a cleaning room 21*a*, a development room 21*b*, and a developer supply room 21*c*, and an exposure light path 21*d* through which exposure light emitted from the laser writing device 60 passes is provided therein. Further, an opening part 21*e* is provided, which communicates the cleaning room 21*a* and the developer supply room 21*c* with the outside of the image forming unit housing 21. This opening part 21*e* is used as a developer accepting part which accepts the supplied developer, as a developer discharge part which discharges the developer, and further as a coupled part for coupling to the developer tank 34 described later, and provided in the direction orthogonal to the longitudinal direction of the image forming unit 20.

This image forming unit 20 includes a photoconductor 24 having the shape of a drum, which is used as an image bearing member; a charge device 26 having a charge roll which charges this photoconductor 24 uniformly; a development device 28 which develops a latent image written on the photoconductor 24 with developer; an erase lamp 30 used as an electricity removing unit which removes electricity from the photoconductor 24; and a cleaning device 32 used as a developer removing device which removes the residual developer from the photoconductor 24 after a developer image has been transferred by the transfer device 70. The image forming unit 20 develops the latent image written on the photoconductor 24 by the laser writing device 60, and forms a developer image on the surface of the photoconductor 24.

The image forming units 20Y, 20M, 20C, 20B are attached or detached to/from the image forming apparatus body 12 through this opening part 12*a* which is in the open state by opening the front cover 14 as described before.

In the developer tank 34Y, yellow developer to be supplied to the development device 28Y is housed; in the developer tank 34M, magenta developer to be supplied to the development device 28M is housed; in the developer tank 34C, cyan developer to be supplied to the development device 28C is housed; and in the developer tank 34B, black developer to be supplied to the development device 28B is housed. Though the respective developer tanks 34Y, 34M, 34C and 34B are different in color of the housed developer, they are the same in structure. Therefore, they will be described below generically as developer tank 34.

The developer tank 34, as shown in FIG. 5, has a developer tank housing 35. The inside of this developer tank housing 35 is divided into a developer supply room 37 and a developer accumulation part 38 used as a developer accumulation part in which the picked-up developer is accumulated. The right-side portion of the developer tank housing 35 in FIG. 5 protrudes thereby to form a protrusion part 35*a*. This protrusion part 35*a* is used as a coupling part for coupling to the image forming unit 20. Namely, this protrusion part 35*a* is inserted into the opening part 21*e* provided for the image forming unit 20, whereby the developer tank 34 and the image forming unit 20 are put in the coupled state to each other. Further, this protrusion part 35*a* is provided in the longitudinal direction of the developer tank 34.

In the developer supply room 37, a supply port 37*a* used as a developer supply part which communicates the developer supply room 37 with the developer supply room 21*c* of the image forming unit 20 is provided at one end in the longitudinal direction of the developer tank 34. Further, for the developer supply room 37, a supply auger 39 used as a supply-developer transport unit which transports developer for supply is provided. The supply auger 39 transports the developer and supplies this developer through the supply port 37*a* to the developer supply room 21*c*. In the developer accumulation room 38, a pick-up port 38*a* used a developer pick-up part which communicates the developer accumulation room 38 with the cleaning room 21*a* of the image forming unit 20 is provided at one end in the longitudinal direction of the developer tank 34. Further, for the developer accumulation room 38, a pick-up auger 40 which transports the picked-up developer is provided. The developer removed from the photoconductor 24 by the cleaning device 32 is picked up through the pick-up port 38*a* to the developer accumulation room 38, and this picked-up developer is transported, by the pick-up auger 40, to the left side in FIG. 5.

Figure 2:
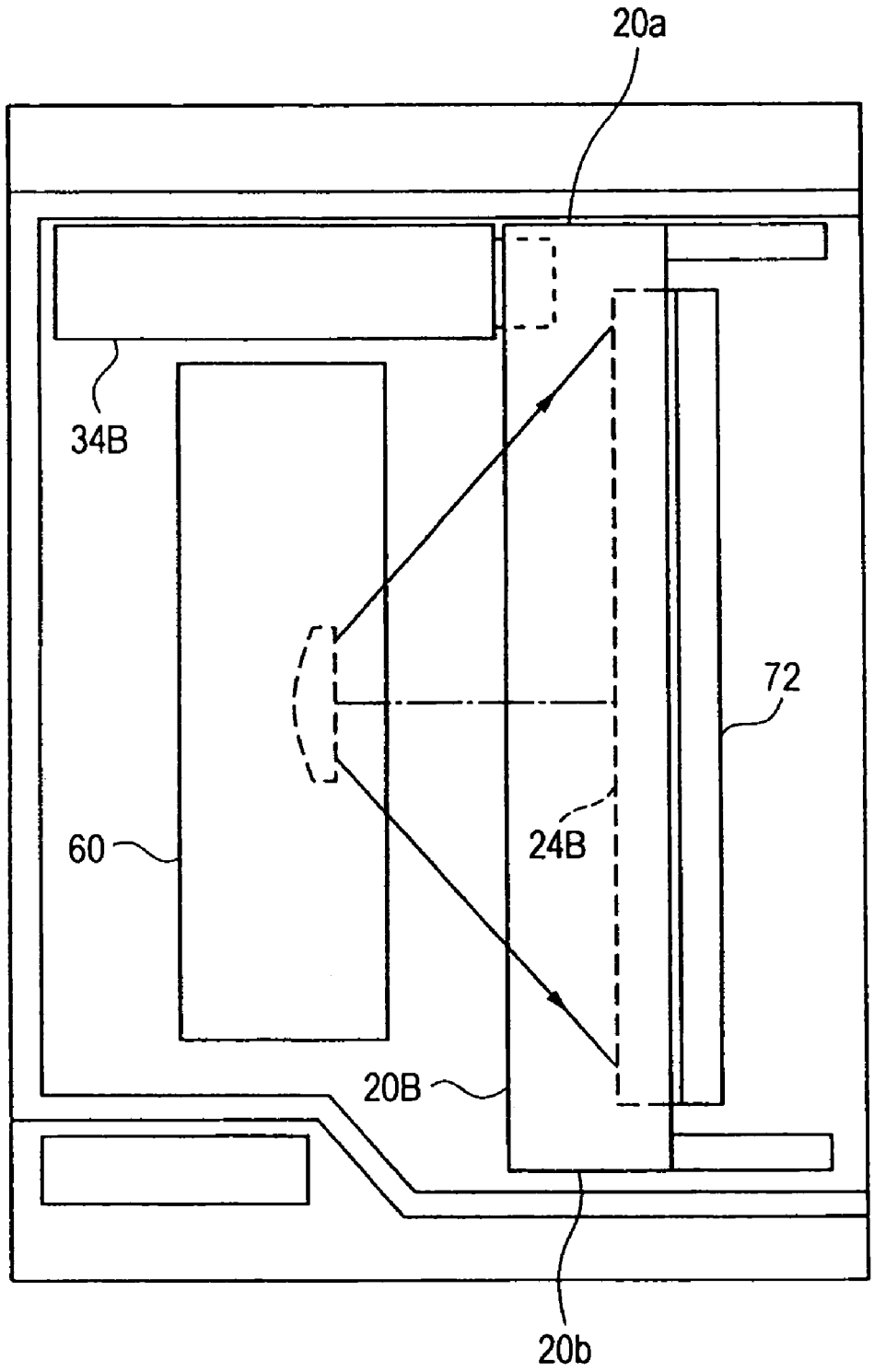
FIG. 2 is a sectional view taken along a line AA in FIG. 1, showing the image forming apparatus according to the first embodiment of the invention.

Further, the developer tank 34 and the image forming unit 20, as shown in FIG. 2, are arranged so that the longitudinal direction of the image forming unit 20 and the longitudinal direction of the developer tank 34 are nearly orthogonal to each other. Further, the developer tank 34 is arranged so that at least its part is located between one end portion 20*a* in the longitudinal direction of the image forming unit 20 and the other end portion 20*b*. In this embodiment, the developer tank 34 is arranged so that the whole of the developer tank 34 is located between one end portion 20*a* and the other end portion 20*b*. However, the developer tank 34 may be arranged so that a part of the developer tank 34 is located between one end portion 20*a* and the other end portion 20*b*. By thus arranging the developer tank 34, it is possible to prevent the size of the image forming apparatus 10 in the longitudinal direction of the image forming unit 20 from increasing.

Further, the developer tank 34 is arranged at or near the end portion 20*a* in the longitudinal direction of the image forming unit 20. Therefore, in other portion than the end portion 20*a* in the longitudinal direction of the image forming unit 20, large space can be secured. Arrangement of other members in this space makes miniaturization of the image forming possible. In this embodiment, in the space obtained by arranging the developer tank 34 at the end portion 20*a* of the image forming unit 20, the laser writing device 60 described later is arranged. However, in this space, other members may be arranged. Further, this developer tank 34 is arranged so that its longitudinal direction is nearly vertical to the longitudinal direction of the image forming unit 20.

Further, the developer tank 34, as shown in FIG. 1, is arranged so that at least its part overlaps with the image forming unit 20 in a horizontal direction. Therefore, compared with a case where the developer tank 34B is arranged so as not to overlap with the image forming unit 20B in the horizontal direction, and the developer tank 34B is provided in a higher position in the gravitational direction than the position of the image forming unit 20B, the image forming apparatus can be miniaturized in the gravitation direction.

Figure 6:
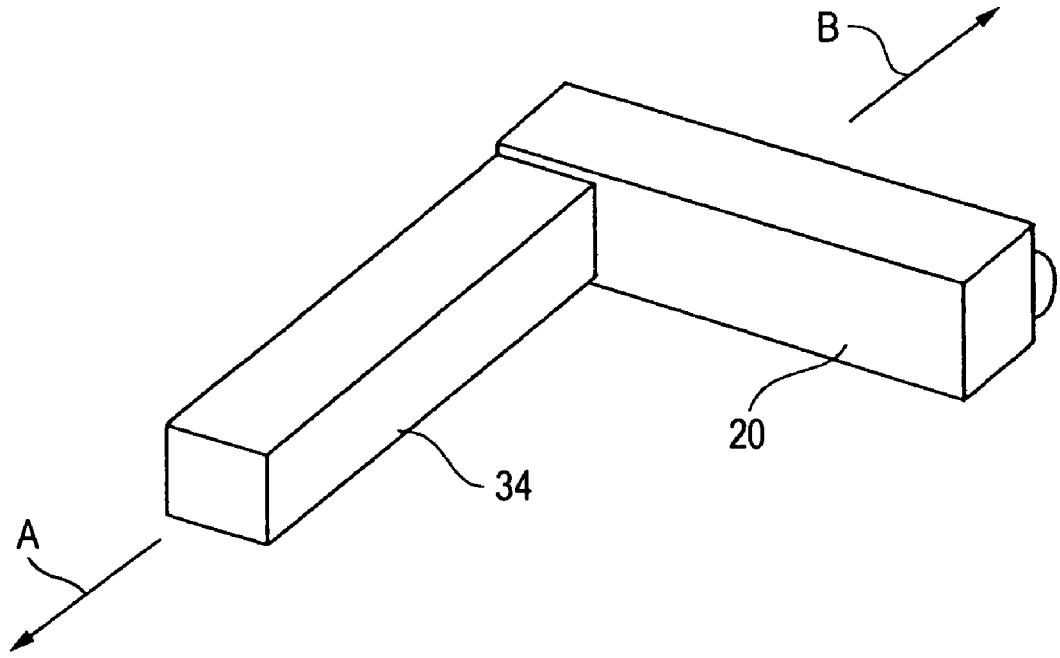
FIG. 6 is an explanatory view showing schematically the directions where the image forming unit and the developer supply unit are taken out from the image forming apparatus according to the first embodiment of the invention.

Further, the developer tank 34 is provided detachably from the image forming apparatus body 12, and the attachment and detachment of the developer tank 34 are performed through the opening part 12*b* in the state where the opening and closing door 15 is opened as described before. The direction in which the developer tank 34 is pulled out from the image forming apparatus body 12 is nearly opposite to the direction in which the image forming unit 20 is provided. Namely, the direction in which the developer tank 34 is pulled out from the image forming apparatus body 12, which is shown by an arrow A in FIGS. 3 and 6, is nearly opposite to the direction in which the image forming unit 20 is provided, viewed on the basis of this developer tank 34. Therefore, even in case that the developer tank 34 is arranged so that at least its part is located between one end portion 20*a* in the longitudinal direction of the image forming unit 20 and the other end portion 20*b*, the developer tank 34 can be attached and detached independently of the image forming unit 20. Namely, it is not necessary to take out the image forming unit 20 from the image forming apparatus body 12 in order to secure the space for attaching and detaching the developer tank 34 to/from the image forming apparatus body 12. Therefore, in the state where the image forming unit 20 is attached to the image forming apparatus body 12, the attachment and detachment of the developer tank 34 can be performed.

Further, the direction in which the developer tank 34 is pulled out from the image forming apparatus body 12 is nearly opposite to the direction in which the image forming unit 20 is pulled out from the image forming apparatus body 12. Namely, as shown in FIGS. 3 and 6, the direction shown by the arrow A in which the developer tank 34 is pulled out from the image forming apparatus body 12 is nearly opposite to the direction shown by an arrow B in which the image forming unit 20 is pulled out from the image forming apparatus body 12. Therefore, even in case that the developer tank 34 is arranged so that at least its part is located between one end portion 20*a* in the longitudinal direction of the image forming unit 20 and the other end portion 20*b*, the developer tank 34 and image forming unit 20 can be independently attached and detached to/from the image forming apparatus body 12 respectively. Namely, even in the state where the developer tank 34 is attached to the image forming apparatus body 12, the image forming unit 20 can be attached or detached to/from the image forming apparatus body 12. Further, even in the state where the image forming unit 20 is attached to the image forming apparatus body 12, the developer tank 34 can be attached or detached to/from the image forming apparatus body 12.

The laser writing device 60 includes a laser exposure device, which emits a laser beam corresponding to a yellow image onto the photoconductor 24Y, a laser beam corresponding to a magenta image onto the photoconductor 24M, a laser beam corresponding to a cyan image onto the photoconductor 24C, and a laser beam corresponding to a black image onto the photoconductor 24B, and writes an electrostatic latent image onto each photoconductor 24. The laser beam emitted from this laser writing device 60, as shown in FIG. 2, while spreading in the shape of a fan, reaches the photoconductor 24. Therefore, the length of the laser writing device 60 in the longitudinal direction of the photoconductor 24 is shorter than the length of the photoconductor 24 in the longitudinal direction. Herein, in the longitudinal direction of the photoconductor 24, the developer tank 34 and the laser writing device 60 are arranged side by side. In the space produced by the difference between the length of the photoconductor 24 in the longitudinal direction and the length of the laser writing device 60 in the same direction, the developer 34 is arranged, so that the image forming apparatus body 12 can be miniaturized.

The transfer device 70 has a transfer device frame 71 formed integrally with the front cover 14. To this transfer device frame 71, there are attached two support rolls 76*a*, 76*b*, a transport belt 72, an absorption roll 74 used as an absorption unit which absorbs a sheet onto this transport belt 72, and transfer rolls 78Y, 78M, 78C, 78B which transfer respectively the developer image formed on each photoconductor 24Y, 24M, 24C, 24B on the sheet which is being transported by the transport belt 72. This transfer device 70 moves with the opening or closing operation of the front cover 14, so that it puts the opening part 12*a* of the image forming apparatus body 12 in the open state or the closed state.

Of the two support rolls 76*a* and 76*b*, the support roll 76*a* is connected to a motor (not shown) which is a drive source, and it is used as a drive roll which itself rotates thereby to rotate the transport belt 72. The support roll 76*b* is used as a driven roll which rotates with the rotation of the transport belt 72.

The transport belt 72 is a belt for transporting the sheet supplied from a regist roll 86 described later to the fixing device 64, and the belt 72 is laid in the vertical direction.

The absorption roll 74 is provided in a state where it comes into pressure contact with the support roll 76*b* through the transport belt 72. The voltage is applied onto the absorption roll 74 from a not-shown power supply, whereby the absorption roll 74 absorbs the sheet onto the transport belt 72 electrostatically.

To the respective transfer rolls 78Y, 78M, 78C and 78B, the transfer bias is applied. The transfer rolls 78Y, 78M, 78C and 78B transfer the developer images formed on the photoconductors 24Y, 24M, 24C and 24B on the sheet being transported by the transport belt 72 in order, and form on the sheet a color developer image in which the developer images of four colors of yellow, magenta, cyan and black are layered.

The fixing device 64 includes a heat roll 64*b* and a pressure roll 64*a*. The fixing device 64 applies heat and pressure to the sheet passing between the heat roll 64*a* and the pressure roll 64*b* thereby to fix the developer image onto the sheet.

The sheet supply and transport system 80 includes a sheet supply cassette 82, a main transport path 88 in which the sheet is transported when an image is formed on only one side of the sheet, and an invert transport path 90 in which the sheet is transported devotedly when images are formed on two sides of the sheet.

The sheet supply cassette 82 is detachably attached to the image forming apparatus body 12, in which a sheet used as transferred body such as plain paper or an OHP sheet is housed. In the vicinity of this sheet supply cassette 82, there are arranged a pick-up roll 84 which picks up a sheet from the sheet supply cassette 82, a feed roll 85 which feeds the sheet picked up by the pick-up roll 84 along the main transport path 88, and a retard roll 87 which fans the sheets in cooperation with the feed roll 85.

The main transport path 88 is a transport path in which the sheet supplied from the sheet supply cassette 82 is transported through the image forming part 16 to the discharge part 13. Along this main transport path 88, in order from the upstream in the sheet transport direction, the feed roll 85 and the retard roll 87, the regist roll 86, the transport belt 72, the fixing device 64, and the discharge roll 89 are arranged.

The invert transport path 90 is a transport path in which the sheet of which the surface has received image formation in the image forming part 16, while being inverted, is transported again to the image forming part 16, and this path is provided for the front cover 14. The sheet of which the surface has received the image formation is led to the invert transport path 90 by the rotation in the opposite direction of the discharge roll 89, further transported by invert transport rolls 92 arranged along the invert transport path 90, and transported through the regist roll 86 to the image forming part 16 again. On a back surface of the sheet inverted by this invert transport path 90, an image is formed by the image forming part 16, so that image formation is performed on both surfaces of the sheet.

Next, the action of the embodiment described above will be described.

As the image forming operation starts, the surface of each photoconductor 24 is uniformly charged by each charge device 26, and latent images are formed on these photoconductors 24 by the light emitted from the laser writing device 60. The latent image on the surface of the photoconductor 24, which has been formed by the laser writing device 60, is developed by the development device 28 thereby to become a developer image.

On the other hand, a sheet housed in the sheet supply cassette 82 of the sheet supply device is picked up by the pick-up roll 84, transported toward the regist roll 86, temporarily stopped at the regist roll 86, and led to the transport belt 72 with timing. Onto this sheet, the developer images formed on the respective photoconductors are transferred by the respective transfer rolls 78Y, 78M, 78C and 78B, so that on the sheet, a developer image in which a yellow developer image, a magenta developer image, a cyan developer image and a black developer image are layered is formed. The sheet on which this developer image has been formed is fed to the fixing device 64, and the developer image is fixed by the fixing device 64. Thereafter, the sheet is discharged to the discharge part 13 by the discharge roll 89.

When the above image forming operation is performed, for example, in case that the image forming unit 20 is attached or detached to/from the image forming apparatus body 12 in order to exchange the image forming unit 20 to a new unit, the front cover 14 is opened thereby to put the opening part 12*a* in the open state, and the image forming unit 20 is detached through this opening part 12*a*. Further, in attachment and detachment of the developer tank 34 to/from the apparatus body, the opening and closing door 15 is opened thereby to put the opening part 12*b* in the open state, and the attachment and detachment are performed through this opening part 12*b*. Here, the direction in which the image forming unit 20 is pulled out from the image forming apparatus body 12 is nearly opposite to the direction in which the developer tank 34 is pulled out from the image forming apparatus body 12.

FIGS. 7 to 11 show a second embodiment of the image forming apparatus 10. Compared with the first embodiment, in the first embodiment, each developer tank 34 is individually attached or detached to/from the image forming apparatus body 12, while in the second embodiment, four developer tanks 34Y, 34M, 34C and 34B are attached or detached to/from the image forming apparatus body 12 together. Further, there is provided a coupling release mechanism 100 used as a coupling release unit for releasing coupling between the developer tank 34 and the image forming unit 20, which is not provided in the first embodiment. Further, an opening part 12*c*, which is not provided in the first embodiment, is provided for the image forming apparatus body 12, and the image forming apparatus body 12 has an opening and closing cover 124 for opening or closing this opening part 12*c*.

Figure 10:
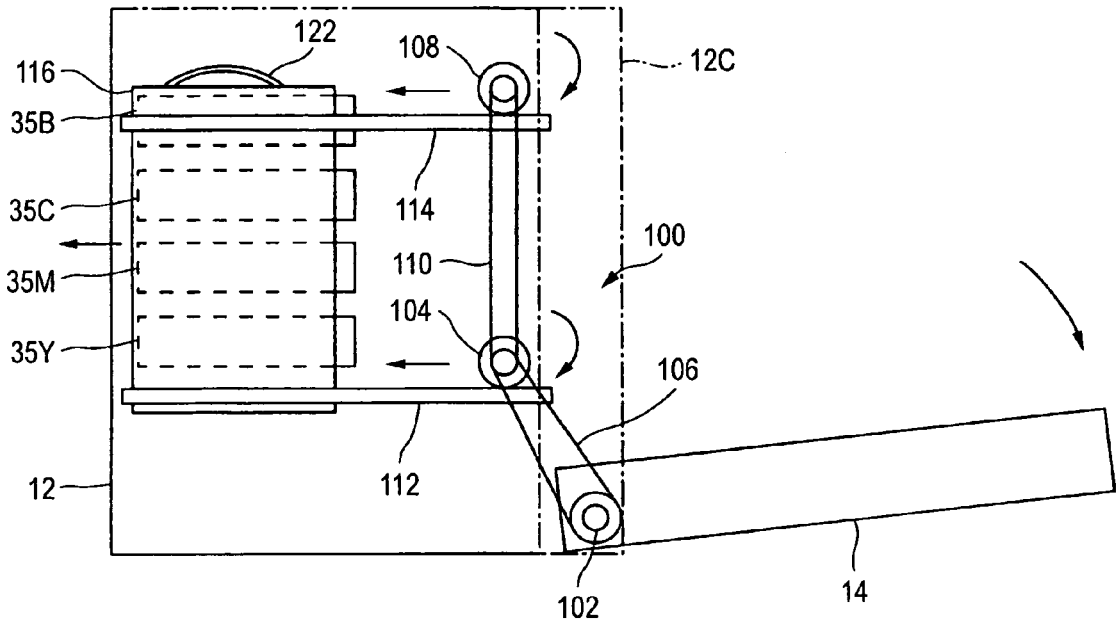
FIG. 10 is an explanatory view showing the constitution of the coupling release unit of the image forming apparatus according to the second embodiment of the invention.
Figure 11:
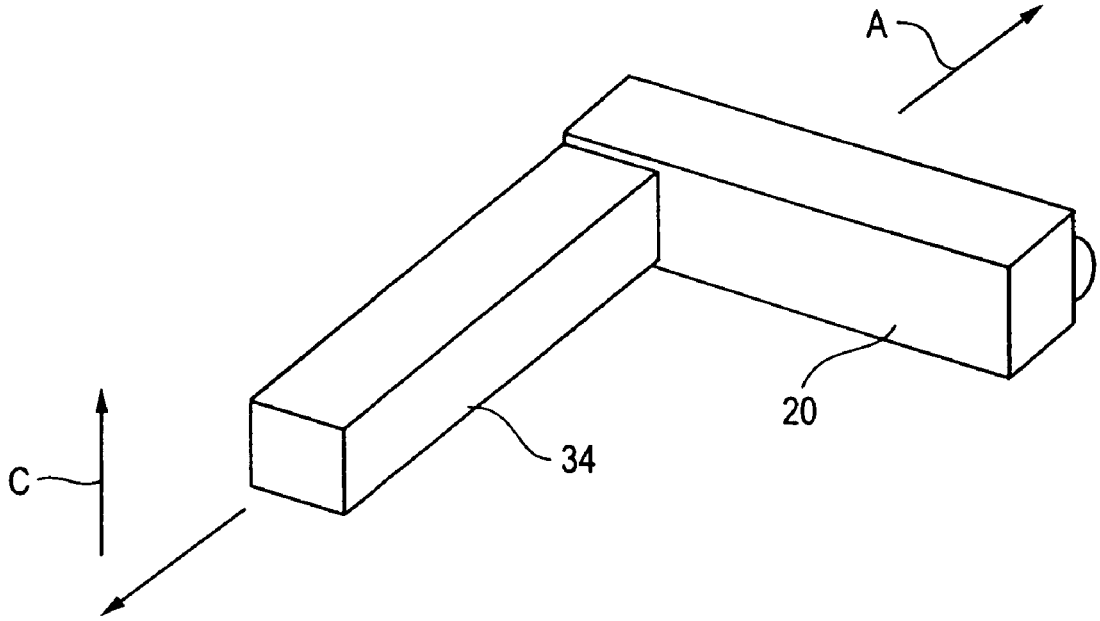
FIG. 11 is an explanatory view showing schematically the directions where the image forming unit and the developer supply unit are taken out from the image forming apparatus according to the second embodiment of the invention.

The coupling release mechanism 100 releases coupling between the developer tank 34 and the image forming unit 20 in cooperation with the opening operation of a front cover 14 used an opening and closing cover. As shown in FIG. 10, the coupling release mechanism 100 includes a front cover pulley 102 which is attached to the front cover 14 and used as a rotator that rotates by the opening operation of the front cover 14, a first driven pulley 104 which rotates upon reception of drive transmission from the front cover pulley 102, a first drive transmission belt 106 which transmits the rotation of the front cover pulley 102 to the first drive pulley 104, a second driven pulley 108 rotates upon reception of drive transmission from the first driven pulley, a second drive transmission belt 110 which transmits the rotation of the first drive pulley to the second drive pulley 108, a first moving plate 112 which moves, upon reception of drive transmission from the first driven pulley 104, horizontally so as to go away from the opening part 12*a*, a second moving plate 114 which moves, upon reception of drive transmission from the second drive pulley 108, in the same direction as the moving direction of the first moving plate 112 by the same distance, and a moving housing 116 which is supported by the first moving plate 112 and the second moving plate 114, and moves in the horizontal direction together with the first moving plate 112 and the second moving plate 114.

Figure 9:
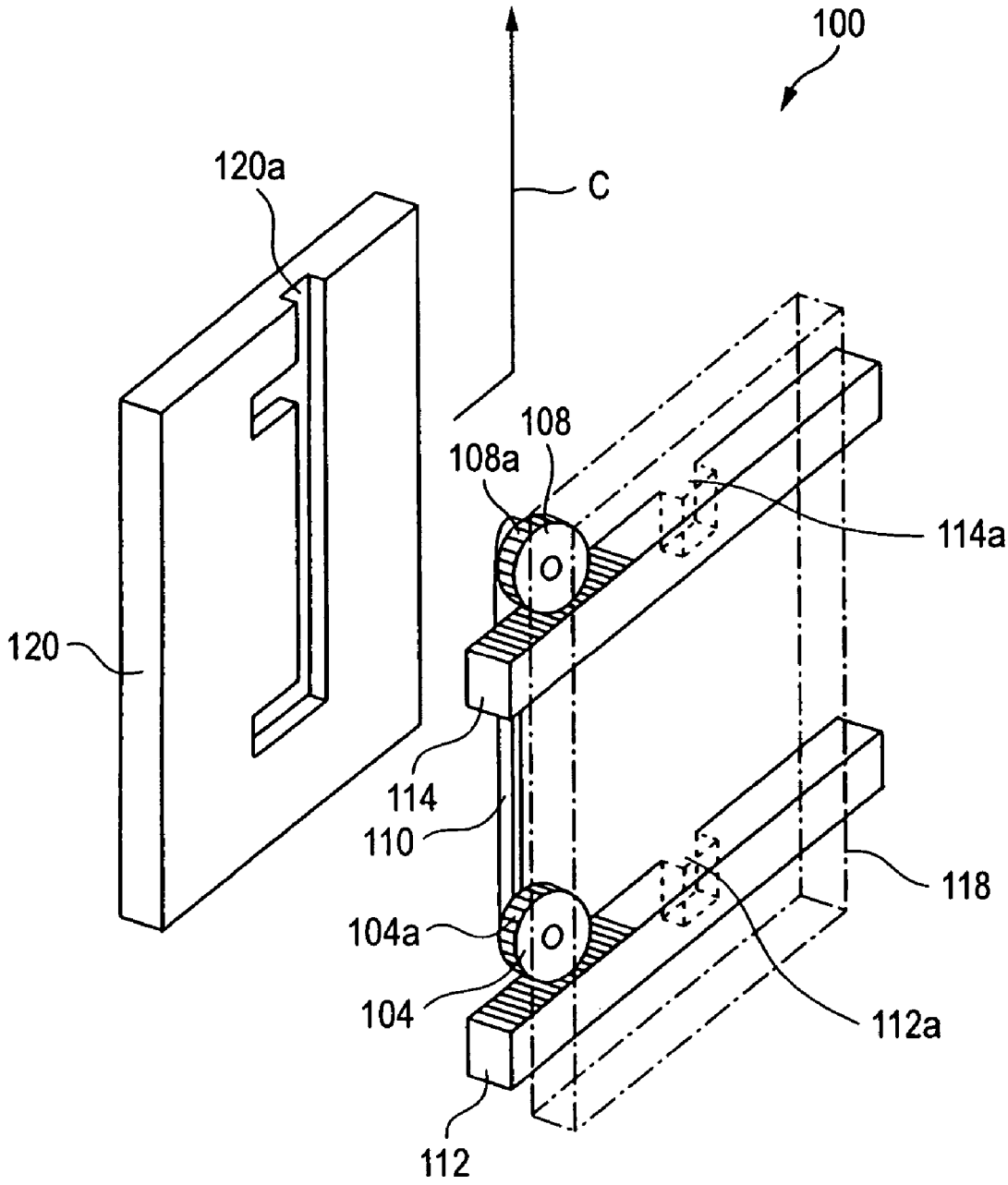
FIG. 9 is a perspective view showing a main portion of a coupling release unit that the image forming apparatus of the second embodiment of the invention.

The first driven pulley 104 and the second driven pulley 108, as shown in FIG. 9, are rotatably supported respectively by a first inner wall portion 118 forming a part of the image forming apparatus body 12. Further, on the peripheral surfaces of the first driven pulley 104 and the second driven pulley 108, a tooth train 104*a*, 108*a* is provided respectively.

The first moving plate 112 is supported by the first inner wall portion 118 slidably in the horizontal direction. Further, a tooth train is provided on the upper surface of the first moving plate 112, this tooth train engages with the tooth train 104*a* of the first driven pulley, and the first moving plate 112, upon reception of drive transmission from the first driven pulley, moves in the horizontal direction. Further, for the first moving plate 112, a notch 112*a* for fitting and supporting the moving housing 116 is provided. The second moving plate 114 is supported by the first inner wall portion 118 slidably in the horizontal direction. Further, a tooth train is provided on the upper surface of the second moving plate 114, this tooth train engages with the tooth train 108*a* of the second driven pulley 108, and the second moving plate 114, upon reception of drive transmission from the second driven pulley, moves by the same distance and in the same direction as the moving distance and the moving direction of the first moving plate 112. Further, for the second moving plate 114, a notch 114*a* for fitting and supporting the moving housing 116 is provided.

Figure 7:
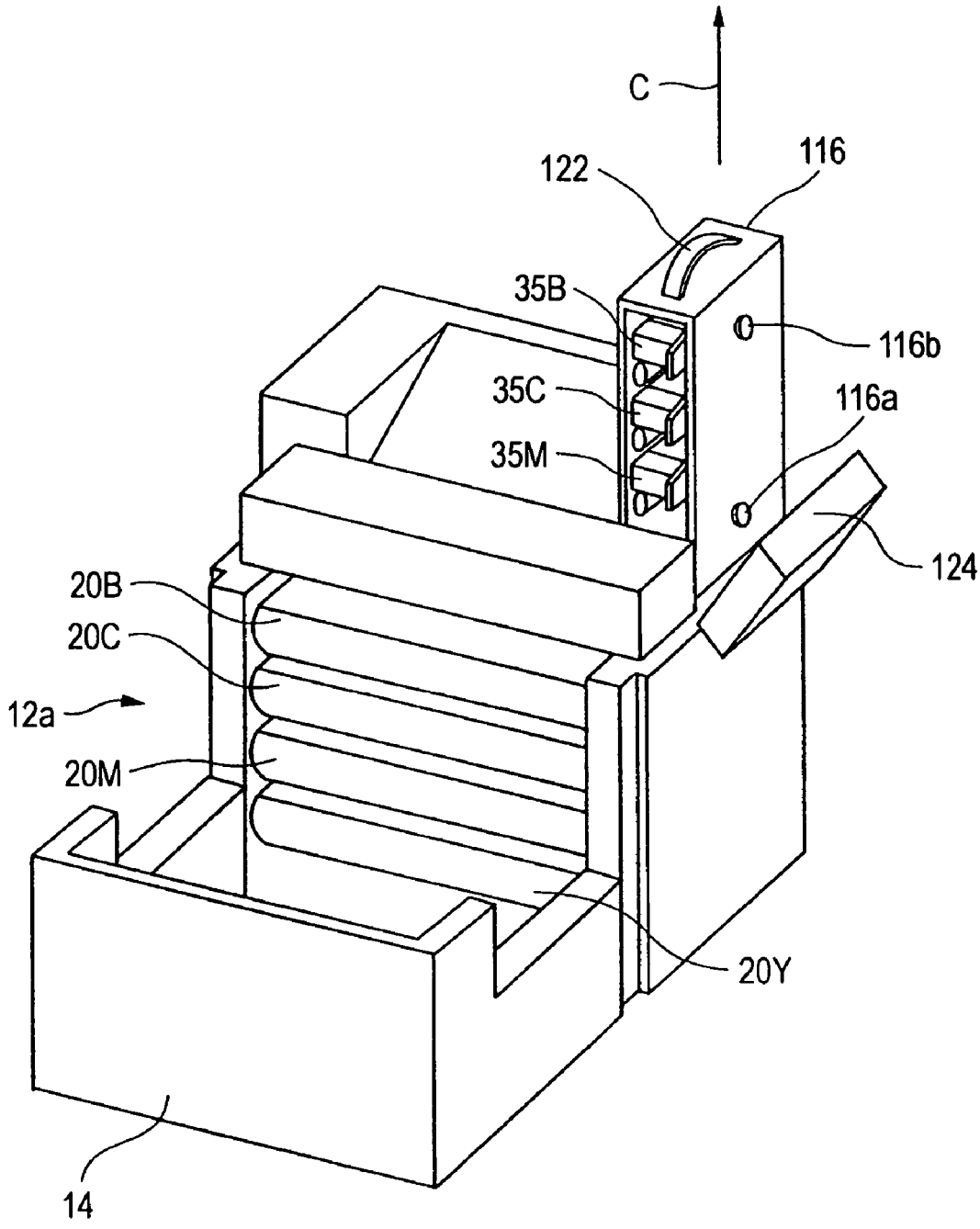
FIG. 7 is a perspective view showing an image forming apparatus according to a second embodiment of the invention.
Figure 8:
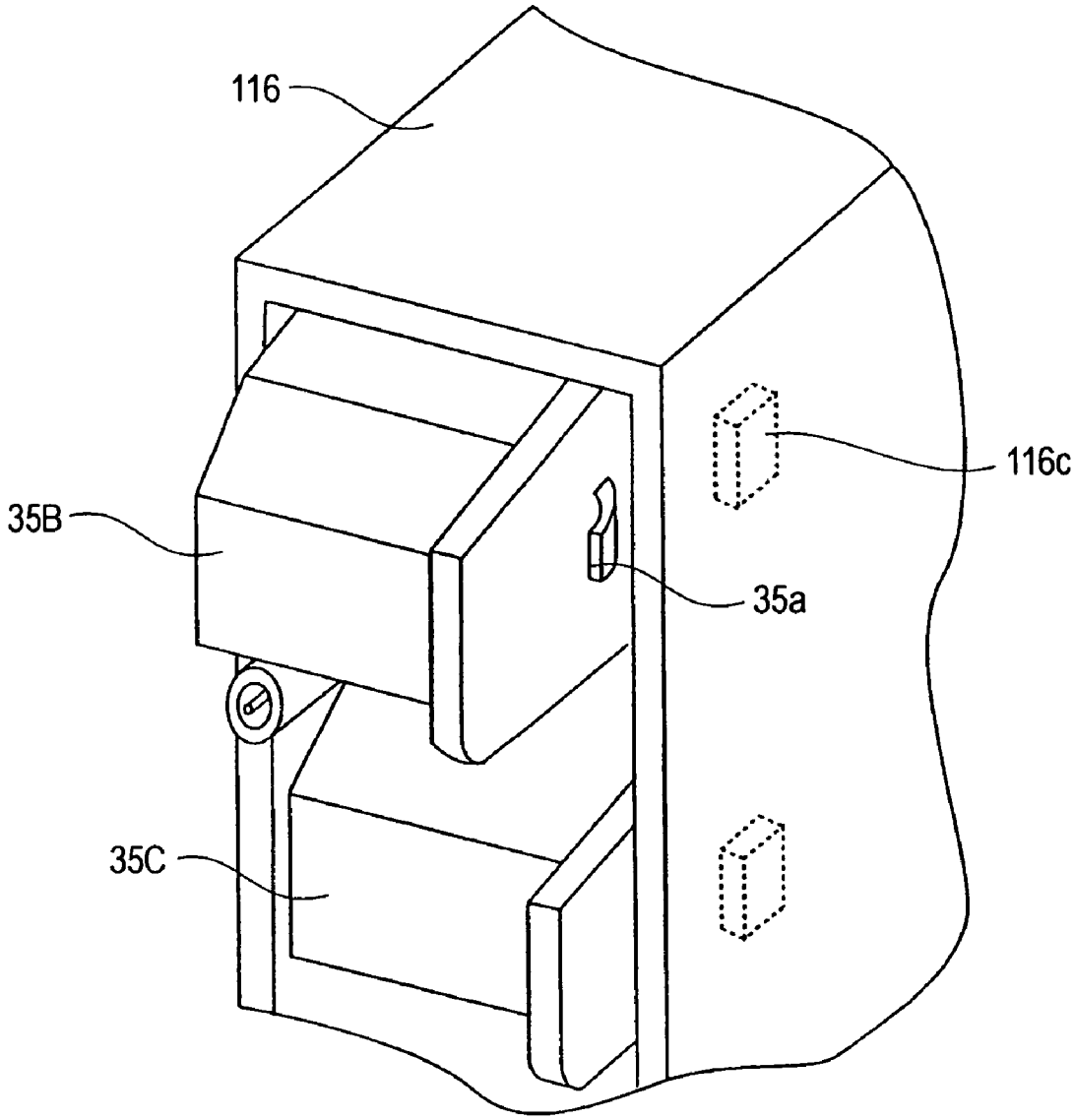
FIG. 8 is a perspective view showing an enlarged main portion of a developer supply unit of the image forming apparatus according to the second embodiment of the invention.

The moving housing 116 includes a first protrusion part 116*a* and a second protrusion part 116*b* on its right sidewall portion in FIG. 7, and third protrusion portion and a fourth protrusion part (not shown) on its left sidewall portion in FIG. 7. When the moving housing 116 is attached to the image forming apparatus body 12, the first protrusion part 116*a* fits to the notch 112*a*, the second protrusion part 116*b* fits to the notch 114*a*, and the third and fourth protrusion parts fit to a guide groove 120*a* provided for a second inner wall portion 120 forming a part of the image forming apparatus body 12. Into this moving housing 116, the developer tanks 34Y, 34M, 34C and 34B are inserted, and a fitting protrusion part provided for each developer tank fits to a fitted notch provided in the inner wall portion of the moving housing 116, so that each developer tank 34Y, 34M, 34C, 34B is positioned to the moving housing 116. For example, as shown in FIG. 8, a fitting projection 35*a* is provided for the developer tank housing 35B, and this fitting projection 35*a* fits to a notch 116*c* provided in the inner wall portion of the moving housing 116, so that the developer tank housing 35B is positioned to the moving housing 116. Further, on the upper surface of the moving housing 116, a grip 112 is provided.

Compared with the case in the first embodiment, in the first embodiment, the direction in which the developer tank 34 is pulled out from the image forming apparatus body 12 is nearly opposite to the direction in which the image forming unit 20 is provided, while in this second embodiment, the direction in which the developer tank 34 is pulled out from the image forming apparatus body 12 is nearly vertical to the direction in which the image forming unit 20 is set. Namely, as shown by an arrow C in FIGS. 7 and 11, the developer tank 34 is pulled out from the image forming apparatus body 12 upward in the gravitational direction, and this direction is nearly vertical to the setting direction of the image forming unit 20, viewed on the basis of the developer tank 34.

Further, compared with the case in the first embodiment, in the first embodiment, the direction in which the developer tank 34 is pulled out from the image forming apparatus body 12 is nearly opposite to the direction in which the image forming unit 20 is pulled out from the image forming apparatus body 12, while in this second embodiment, the direction in which the developer tank 34 is pulled out from the image forming apparatus body 12 is nearly vertical to the direction in which the image forming unit 20 is pulled out from the image forming apparatus body 12. Namely, the direction shown by the arrow C in FIGS. 7 and 11 in which the developer tank 34 is pulled out from the image forming apparatus body is nearly vertical to the direction shown by an arrow A in FIG. 11 in which the image forming unit 20 is pulled out from the image forming apparatus body 12.

In the second embodiment, in FIGS. 7 to 11, the same portions as those in the first embodiment are denoted by the same reference numerals, and their description are omitted.

Next, the action in the above-mentioned second embodiment will be described.

In order to pull out the developer tanks 34Y, 34M, 34C and 34B from the image forming apparatus body 12, firstly, the opening and closing cover 124 is opened thereby to put the opening part 12*c* in the open state. Succeedingly, the front cover 14 is opened thereby to put the opening part 12*a* in the open state. As the front cover 14 is opened, in cooperation with this opening operation, the coupling release mechanism 100 operates, and coupling between each developer tank 34Y, 34M, 34C, 34B and each image forming unit 20Y, 20M, 20C, 20B is released.

Namely, as the front cover 14 opens, the front cover pulley 102 rotates in cooperation with this opening operation, this rotation is transmitted to the first drive transmission belt 106, the first driven pulley 104, the first moving plate 112, and the moving housing 116 in order. Further, the rotation is transmitted to the first drive transmission belt 106, the first driven pulley 104, the second drive transmission belt 110, the second driven pulley 108, the second moving plate 114, and the moving housing 116 in order, so that the moving housing 116 moves to the left in FIG. 10. By the movement of the moving housing 116, the developer tanks 34Y, 34M, 34C and 34B attached to this moving housing 116 move together with the moving housing 116, and the protrusion part 35*a* of each developer tank housing 35 is pulled out from the opening part 21*e* (refer to FIG. 5) of each image forming unit housing 21, so that coupling between each developer tank 34Y, 34M, 34C, 34B and each image forming unit 20Y, 20M, 20C, 20B is released. Thereafter, using the grip 122, the moving housing 116 is pulled out upward from the image forming apparatus body 12, and each developer tank 34Y, 34M, 34C, 34B is taken out from the moving housing 116.

In order to attach the developer tanks 34Y, 34M, 34C and 34B to the image forming apparatus body 12, the developer tanks 34Y, 34M, 34C and 34B are attached to the moving housing 116, this moving housing 116 is attached through the opening part 12*c* to the image forming apparatus body 12 from the upside, and further the moving housing 116 is moved to the right in FIG. 10. Upon completion of a series of these operations, the protrusion part 35*a* of each developer tank housing 35 is put in the coupled state to the opening part 21*e* of each image forming unit 20, so that each developer tank 34 is attached to the image forming apparatus body 12.

The image forming units 20Y, 20M, 20C and 20B, similarly to the case in the first embodiment, are attached to the image forming apparatus body 12 through the opening part 12*a* formed by opening the front cover 14.

As described above, in the second embodiment, the coupling release mechanism 100 releases coupling between the developer tank 34 and the image forming unit 20 in cooperation with the front cover 14 which opens or closes the opening part 12*a* through which each image forming unit 20 is attached or detached. The coupling release mechanism 100 should cooperate with opening and closing of the opening and closing cover which opens or closes the opening part used for attachment and detachment of at least one of the image forming unit 20 and the developer tank 34. Namely, the coupling release mechanism 100 may release coupling between the developer tank 34 and the image forming unit 20 in cooperation with the opening operation of the opening and closing cover 124 which opens or closes the opening part 12*c* through which the developer tank 34 is attached or detached.

As described above, the invention can be applied to an image forming apparatus such as a copying machine, a facsimile device, or a printer.

The entire disclosure of Japanese Patent Application No. 2005-274964 including specification, claims, drawings and abstract is incorporated herein by reference in its entirely.

What is claimed is:

1. An image forming apparatus comprising:

an image forming unit having a developer accepting part accepting supplied developer; and a developer supply unit having a developer supply part supplying the developer to the developer accepting part, wherein the developer accepting part is provided near one end in the longitudinal direction of the image forming unit, the developer supply part is provided near one end in the longitudinal direction of the developer supply unit, and the image forming unit and the developer supply unit are arranged in a position where one end in the longitudinal direction of the developer supply unit is nearly orthogonal to the image forming unit near one end in the longitudinal direction of the image forming unit;

wherein at least part of the one end of the developer supply unit that extends in the longitudinal direction of the developer supply unit is connected within the one end of the image forming unit, wherein the developer supply unit includes a supply auger and a pick-up auger, and at least part of the supply auger and a pick-up auger are provided within the image forming unit.

2. The image forming apparatus according to claim 1, further comprising:

an image bearing member and a latent image forming device forming a latent image on this image bearing member, wherein the developer supply unit and the latent image forming device are arranged side by side in the longitudinal direction of the image bearing member.

3. The image forming apparatus according to claim 1, wherein the developer supply unit is attached to an image forming apparatus body detachably, and the direction in which the developer supply unit is pulled out from the image forming apparatus body is nearly opposite to the direction in which the image forming unit is set.

4. The image forming apparatus according to claim 1, wherein the developer supply unit is attached to the image forming apparatus body detachably, and the direction in which the developer supply unit is pulled out from the image forming apparatus body is nearly vertical to the direction in which the image forming unit is set.

5. The image forming apparatus according to claim 1, wherein the image forming unit and the developer supply unit are attached to the image forming apparatus body detachably, and the direction in which the image forming unit is pulled out from the image forming apparatus body is nearly opposite to the direction in which the developer supply unit is pulled out from the image forming apparatus body.

6. The image forming apparatus according to claim 1, wherein the image forming unit and the developer supply unit are attached to the image forming apparatus body detachably, and the direction in which the image forming unit is pulled out from the image forming apparatus body is nearly vertical to the direction in which the developer supply unit is pulled out from the image forming apparatus body.

7. The image forming apparatus according to claim 1, wherein the developer supply unit has a coupling part and the image forming unit has a coupled part; and the coupling part and the coupled part are coupled to each other.

8. The image forming apparatus according to claim 7 further comprising:

an image forming apparatus body having an opening part used for attachment and detachment of at least one of the image forming unit and the developer supply unit;

an opening and closing cover opening/closing the opening part; and a coupling release unit releasing coupling between the image forming unit and the developer supply unit in cooperation with the opening operation of this opening and closing cover.

9. The image forming apparatus according to claim 1, wherein the image forming unit includes a developer removing device removing developer from a surface of the image bearing member and a developer discharge part discharging the developer removed by the developer removing device and wherein the developer supply unit includes a developer pick-up part picking up the developer discharged from the developer discharge part and a developer accumulation part in which the developer picked up by this developer pick-up part is accumulated.

10. The image forming apparatus according to claim 9, wherein the developer discharge part is provided in the nearly orthogonal direction to the longitudinal direction of the image forming unit, and the developer pick-up part is provided at one end in the longitudinal direction of the developer supply unit.

11. The image forming apparatus according to claim 10, wherein the developer supply unit comprises a protrusion part, the image forming unit comprises an opening part, and the protrusion part is inserted into the opening part.

* * * * *